US008618904B2

(12) United States Patent
Tsukizawa et al.

(10) Patent No.: US 8,618,904 B2
(45) Date of Patent: Dec. 31, 2013

(54) ESD PROTECTION DEVICE

(75) Inventors: Takayuki Tsukizawa, Nagaokakyo (JP); Tetsuya Ikeda, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/570,277

(22) Filed: Aug. 9, 2012

(65) Prior Publication Data

US 2012/0299693 A1 Nov. 29, 2012

Related U.S. Application Data

(63) Continuation of application No. PCT/JP2001/051767, filed on Jan. 28, 2011.

(30) Foreign Application Priority Data

Feb. 15, 2010 (JP) ..... 2010-030742
Feb. 15, 2010 (JP) ..... 2010-030743

(51) Int. Cl.
*H01C 7/10* (2006.01)

(52) U.S. Cl.
USPC ..... 338/21; 338/13

(58) Field of Classification Search
USPC ..... 338/21
See application file for complete search history.

(56) References Cited

U.S. PATENT DOCUMENTS

2011/0279945 A1* 11/2011 Tsukizawa et al. ..... 361/220

FOREIGN PATENT DOCUMENTS

| | | | |
|---|---|---|---|
| EP | 2 242 154 | A1 | 10/2010 |
| JP | 54-069342 | U | 5/1979 |
| JP | 03-194878 | A | 8/1991 |
| JP | 06-068949 | A | 3/1994 |
| JP | 11-354248 | A | 12/1999 |
| JP | 2001-043954 | A | 2/2001 |
| JP | 2001-076840 | A | 3/2001 |
| JP | 2001-185322 | A | 7/2001 |
| JP | 2001-267037 | A | 9/2001 |
| JP | 2003-297524 | A | 10/2003 |
| JP | 2005-276513 | A | 10/2005 |
| JP | 2006-294357 | A | 10/2006 |
| JP | 2009-238563 | A | 10/2009 |
| JP | 2009-295760 | A | 12/2009 |
| WO | 2009/098944 | A1 | 8/2009 |

OTHER PUBLICATIONS

Official Communication issued in International Patent Application No. PCT/JP2011/051767, mailed on Mar. 29, 2011.
Ikeda et al., "Method for Manufacturing ESD Protection Device and ESD Protection Device," , U.S. Appl. No. 13/565,878, filed Aug. 3, 2012.

* cited by examiner

*Primary Examiner* — Kyung Lee
(74) *Attorney, Agent, or Firm* — Keating & Bennett, LLP

(57) ABSTRACT

An ESD protection device includes a ceramic multilayer substrate in which a plurality of ceramic insulating layers are laminated; a first connecting conductor extending through the main surfaces of the insulating layer; a mixture portion extending along a main surface of the insulating layer including the first connecting conductor and connected to the first connecting conductor, the mixture portion including a material dispersed therein, the material including at least one selected from a metal and a semiconductor, a metal and a ceramic, a semiconductor and a ceramic, a semiconductor, and a metal coated with an inorganic material; and a second connecting conductor that has electrical conductivity and is connected to the mixture portion and extends along the main surface of the insulating layer on which the mixture portion is provided.

14 Claims, 11 Drawing Sheets

ESD PROTECTION DEVICE

BACKGROUND OF THE INVENTION

1. Field of the Invention

The present invention relates to an ESD protection device, in particular, to an ESD protection device such as a single component having an ESD protection function only (ESD protection device) or a composite component (module) having an ESD protection function and another function.

2. Description of the Related Art

Electro-static discharge (ESD) is a phenomenon that, when a charged electrically conductive object (such as a human body) comes into contact with or comes sufficiently close to another electrically conductive object (such as an electronic device), a strong discharge is generated. ESD causes problems such as damage to and malfunction of electronic devices. To avoid such problems, an excessively high voltage generated at the time of discharge needs to be prevented from being applied to circuits of electronic devices. For such a purpose, ESD protection devices are used and they are also called surge absorbing devices or surge absorbers.

For example, such an ESD protection device is disposed between a signal path of a circuit and the ground. The ESD protection device has a structure in which a pair of discharge electrodes are opposed to each other at a distance from each other. Accordingly, the device has a high resistance and hence signals do not flow to the ground in the normal usage state. However, when an excessively high voltage is applied, for example, in the case of application of static electricity to a cellular phone through the antenna of the cellular phone, a discharge is generated between the discharge electrodes of the ESD protection device so that the static electricity can be made to flow to the ground. As a result, the voltage due to static electricity is not applied to the circuit disposed downstream of the ESD device to thereby protect the circuit.

For example, an ESD protection device illustrated in FIG. 16 (exploded perspective view) and FIG. 17 (sectional view) has the following configuration. In a ceramic multilayer substrate 7 in which insulating ceramic sheets 2 are laminated, a hollow portion 5 is formed; discharge electrodes 6 that are in electrical connection with outer electrodes 1 are disposed in the hollow portion 5 so as to oppose each other; and a discharge gas is contained in the hollow portion 5. When a voltage that produces an electrical breakdown is applied between the discharge electrodes 6, a discharge is generated between the discharge electrodes 6 in the hollow portion 5. As a result of this discharge, the excessively high voltage is introduced to the ground. Thus, the circuit disposed downstream of the ESD protection device can be protected (See, for example, Japanese Unexamined Patent Application Publication No. 2001-43954).

In such an ESD protection device, the ESD responsivity needs to be adjusted by changing the area of the opposing regions of the discharge electrodes. However, this adjustment is limited by, for example, the product size. Accordingly, desired ESD responsivity is less likely to be achieved.

In addition, the ESD protection device has the following problems. When static electricity at a high voltage is successively applied to the device, the discharge electrodes begin to melt. Thus, a short circuit is caused between the discharge electrodes; or the distance between the discharge electrodes is increased and the discharge starting voltage is increased.

SUMMARY OF THE INVENTION

Under the circumstances, preferred embodiments of the present invention provide an ESD protection device in which desired ESD responsivity can be easily achieved and the reliability of the ESD protection function can be enhanced.

An ESD protection device according to a preferred embodiment of the present invention includes a ceramic multilayer substrate in which a plurality of ceramic insulating layers are laminated; a first connecting conductor that has electrical conductivity and extends through main surfaces of at least one of the insulating layers; a mixture portion that extends along one of the main surfaces of the insulating layer including the first connecting conductor and is connected to the first connecting conductor, the mixture portion including a material dispersed therein, the material containing at least one selected from (i) a metal and a semiconductor, (ii) a metal and a ceramic, (iii) a metal, a semiconductor, and a ceramic, (iv) a semiconductor and a ceramic, (v) a semiconductor, (vi) a metal coated with an inorganic material, (vii) a metal coated with an inorganic material and a semiconductor, (viii) a metal coated with an inorganic material and a ceramic, and (ix) a metal coated with an inorganic material, a semiconductor, and a ceramic; and a second connecting conductor that has electrical conductivity, is separated from the first connecting conductor, is connected to the mixture portion, and extends along the main surface of the at least one insulating layer on which the mixture portion is provided.

In this case, when a voltage of a predetermined value or higher is applied between the first connecting conductor and the second connecting conductor, a discharge is generated in the mixture portion.

In the above-described configuration, at least one of the discharge electrodes disposed with the mixture portion therebetween, that is, the first connecting conductor defines an interlayer connecting conductor. As a result, heat generated at the time of the application of static electricity can be dissipated through the interlayer connecting conductor having a higher thermal conductivity than in-plane connecting conductors. Thus, a temperature increase due to repeated discharge can be significantly reduced and prevented and melting of the discharge electrodes can be significantly reduced and prevented. Thus, the reliability of the ESD protection function can be enhanced.

As with the second connecting conductor, the mixture portion can be formed by a thick-film printing process, for example, and hence can be easily formed. Since the mixture portion can be disposed at a desired position in the lamination direction with respect to the interlayer connecting conductor, the degree of freedom in design can be enhanced. Thus, desired ESD responsivity can be easily achieved.

In a preferred embodiment of the present invention, the second connecting conductor preferably extends along the main surface of the at least one insulating layer on which the mixture portion is provided and surrounds the outer periphery of the mixture portion, and is electrically connected to the outer periphery of the mixture portion; and the first connecting conductor is concentric with the mixture portion and extends through the main surfaces of the at least one insulating layer, and is electrically connected to the mixture portion so as to be separated from the outer periphery of the mixture portion.

In this case, since the entirety of the circular periphery of the mixture portion connected to the second connecting conductor is used, the discharge width is increased to facilitate discharging. By forming the mixture portion in the shape of a concentric circle, an ESD discharge portion having a greatly increased size can be formed in a limited area. Since the entirety of the circular periphery of the mixture portion connected to the second connecting conductor is used, the discharge width is increased to facilitate discharging. Thus, desired ESD responsivity can be easily achieved.

A hollow portion is preferably arranged in contact with the mixture portion and a main surface of the second connecting conductor.

In this case, by forming the hollow portion, a gaseous discharge can be generated and ESD characteristics can be further enhanced.

The first connecting conductor is preferably directly connected to the mixture portion.

In this case, the configuration can be simplified. The first connecting conductor may be disposed such that an end surface of the first connecting conductor is just in contact with the center of the mixture portion and the first connecting conductor does not extend through the mixture portion. Alternatively, an opening may be provided in the center of the mixture portion and the periphery of the opening may be connected to the outer periphery of the second connecting conductor.

In a preferred configuration, an opening is provided in a center of the mixture portion; a third connecting conductor is further provided that has electrical conductivity, extends along the main surface of the at least one insulating layer on which the mixture portion is located, and is connected to the periphery of the opening of the mixture portion; and the first connecting conductor is connected to the third connecting conductor.

In this case, while a sufficiently large discharge width is provided, the distance (discharge gap) between the first connecting conductor and the third connecting conductor that oppose each other via the mixture portion can be decreased.

In the mixture portion, a metal material and a semiconductor material are preferably dispersed.

In this case, the metal material and the semiconductor material are dispersed in the mixture portion in which a discharge is generated. Accordingly, electrons easily move and the discharge phenomenon occurs more efficiently. Thus, ESD responsivity can be enhanced.

In addition, fluctuations in the ESD responsivity due to variations in the distance between the discharge electrodes can be reduced. Thus, the adjustment and stabilization of ESD characteristics can be easily achieved.

In a preferred embodiment, the semiconductor material is silicon carbide or zinc oxide, for example.

In the mixture portion, a metal material coated with an insulating inorganic material is preferably dispersed.

In this case, since metal material particles in the mixture portion are coated with the inorganic material, the metal material particles are not in direct contact with each other. Accordingly, the probability of the occurrence of a short circuit due to the connection among the metal material particles is significantly decreased.

A sealing layer is preferably further provided between the insulating layer and the mixture portion and/or between the insulating layer and the hollow portion, so as to extend along the insulating layer.

In this case, permeation of a glass component in the ceramic multilayer substrate into the mixture portion can be significantly reduced and prevented.

A hollow is preferably formed so as to be in contact with the first connecting conductor, the mixture portion, and the second connecting conductor.

In this case, by forming the hollow, a gaseous discharge can be generated and ESD characteristics can be further enhanced.

In the mixture portion, a metal material and a semiconductor material are preferably dispersed.

In this case, the metal material and the semiconductor material are dispersed in the mixture portion in which a discharge is generated. Accordingly, electrons easily move and the discharge phenomenon occurs more efficiently. Thus, ESD responsivity can be enhanced.

In addition, fluctuations in the ESD responsivity due to variations in the distance between the discharge electrodes can be reduced. Thus, the adjustment and stabilization of ESD characteristics can be easily achieved.

In a preferred embodiment, the semiconductor material dispersed in the mixture portion is silicon carbide or zinc oxide.

In the mixture portion, a metal material coated with an insulating inorganic material is preferably dispersed.

In this case, since metal material particles in the mixture portion are coated with the inorganic material, the metal material particles are not in direct contact with each other. Accordingly, the probability of the occurrence of a short circuit due to the connection among the metal material particles is decreased.

A sealing layer is preferably further provided between the insulating layer and the mixture portion and/or between the insulating layer and the hollow, so as to extend along the insulating layer.

In this case, permeation of a glass component in the ceramic multilayer substrate into the mixture portion can be suppressed.

According to various preferred embodiments of the present invention, desired ESD responsivity can be easily achieved and the reliability of the ESD protection function can be enhanced.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments according to the present invention will be described with reference to FIGS. 1 to 15.

First Preferred Embodiment

An ESD protection device 10 according to a first preferred embodiment will be described with reference to FIGS. 1 to 3 and 9.

Figure 1:
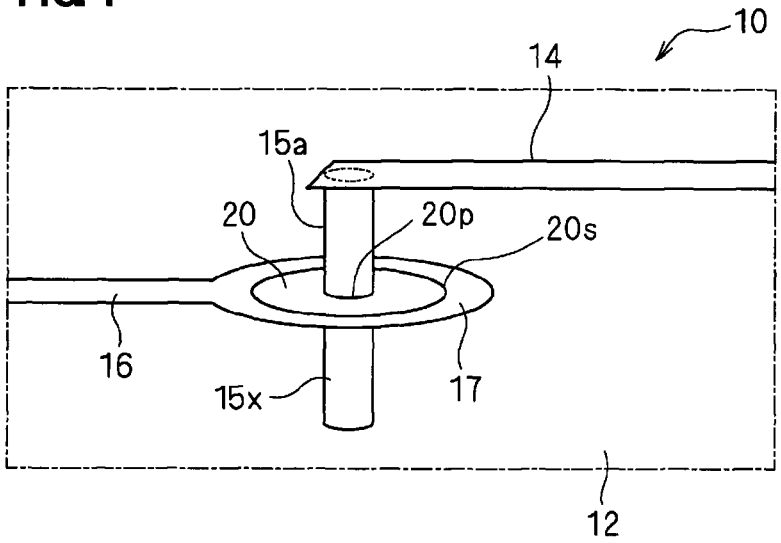
FIG. 1 is a schematic view of an ESD protection device according to a first preferred embodiment of the present invention.
Figure 2:
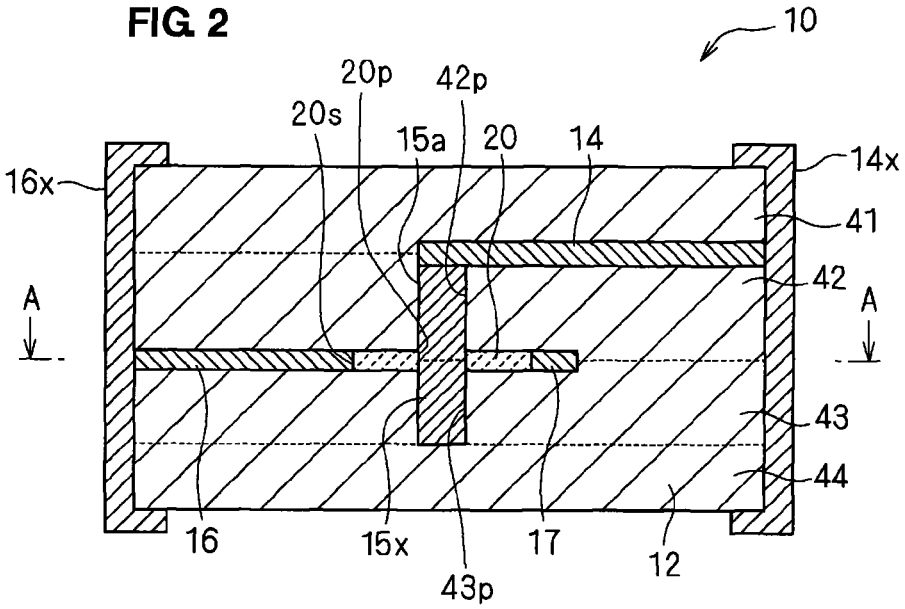
FIG. 2 is a sectional view of an ESD protection device according to the first preferred embodiment of the present invention.
Figure 3:
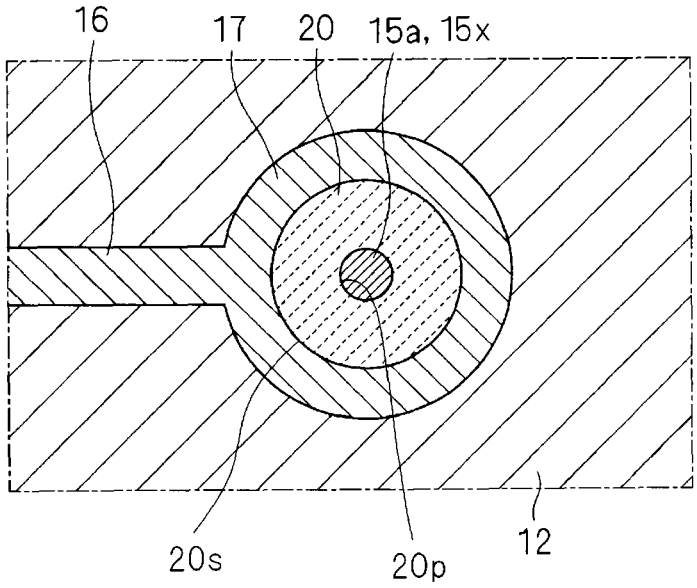
FIG. 3 is a sectional view of a main portion of an ESD protection device according to the first preferred embodiment of the present invention.

FIG. 1 is a schematic view illustrating the internal structure of the ESD protection device 10. FIG. 2 is a sectional view of the ESD protection device 10. FIG. 3 is a sectional view of a main portion taken along line A-A in FIG. 2.

As illustrated in FIGS. 1 to 3, the ESD protection device 10 includes a ceramic multilayer substrate 12 in which first to fourth insulating layers 41 to 44 composed of a ceramic material are laminated. The ceramic multilayer substrate 12 includes a mixture portion 20, first to third in-plane connecting conductors 14, 16, and 17, and first and second interlayer connecting conductors 15*a* and 15*x*.

The mixture portion 20 and the second and third in-plane connecting conductors 16 and 17 are disposed between the second and third insulating layers 42 and 43, which are next to each other, so as to extend along opposing main surfaces of the second and third insulating layers 42 and 43.

As illustrated in FIG. 3, the mixture portion 20 preferably has an outer periphery 20*s* that is circular or substantially circular. The third in-plane connecting conductor 17 is surrounds the outer periphery 20*s* of the mixture portion 20 and is connected to the entirety of the outer periphery 20*s* of the mixture portion 20. The third connecting conductor 17 is connected to the second in-plane connecting conductor 16. The third in-plane connecting conductor 17 serves as a second connecting conductor.

As illustrated in FIG. 2, in the second and third insulating layers 42 and 43, first and second via holes (through holes) 42*p* and 43*p* extending through main surfaces of the second and third insulating layers 42 and 43 are concentric with the mixture portion 20. In the first and second via holes 42*p* and 43*p*, the first and second interlayer connecting conductors 15*a* and 15*x* are provided.

In the interlayer connecting conductors 15*a* and 15*x*, opposing end surfaces thereof in a direction in which the insulating layers 41 to 44 are laminated (vertical direction in FIG. 2) are joined together. Specifically, as illustrated in FIG. 3, an opening 20*p* is formed in the center of the mixture portion 20; and the interlayer connecting conductors 15*a* and 15*x* extend through the opening 20*p*. The outer periphery of the interlayer connecting conductors 15*a* and 15*x* is connected to the periphery of the opening 20*p* of the mixture portion 20. The first interlayer connecting conductor 15*a* serves as a first connecting conductor.

As illustrated in FIG. 2, the first in-plane connecting conductor 14 is located between the first and second insulating layers 41 and 42, which are next to each other, so as to extend along opposing main surfaces of the first and second insulating layers 41 and 42. The first interlayer connecting conductor 15*a* is connected to the first in-plane connecting conductor 14.

The first and second in-plane connecting conductors 14 and 16 extend to the side surfaces of the ceramic multilayer substrate 12 and are respectively connected to first and second outer terminals 14*x* and 16*x*.

The first to third in-plane connecting conductors 14, 16, and 17, the first and second interlayer connecting conductors 15*a* and 15*x*, and the first and second outer terminals 14*x* and 16*x* have electrical conductivity.

In the mixture portion 20, a material is dispersed, the material containing at least one selected from (i) a metal and a semiconductor, (ii) a metal and a ceramic, (iii) a metal, a semiconductor, and a ceramic, (iv) a semiconductor and a ceramic, (v) a semiconductor, (vi) a metal coated with an inorganic material, (vii) a metal coated with an inorganic material and a semiconductor, (viii) a metal coated with an inorganic material and a ceramic, and (ix) a metal coated with an inorganic material, a semiconductor, and a ceramic. The mixture portion 20 has an insulating property on the whole.

Figure 9:
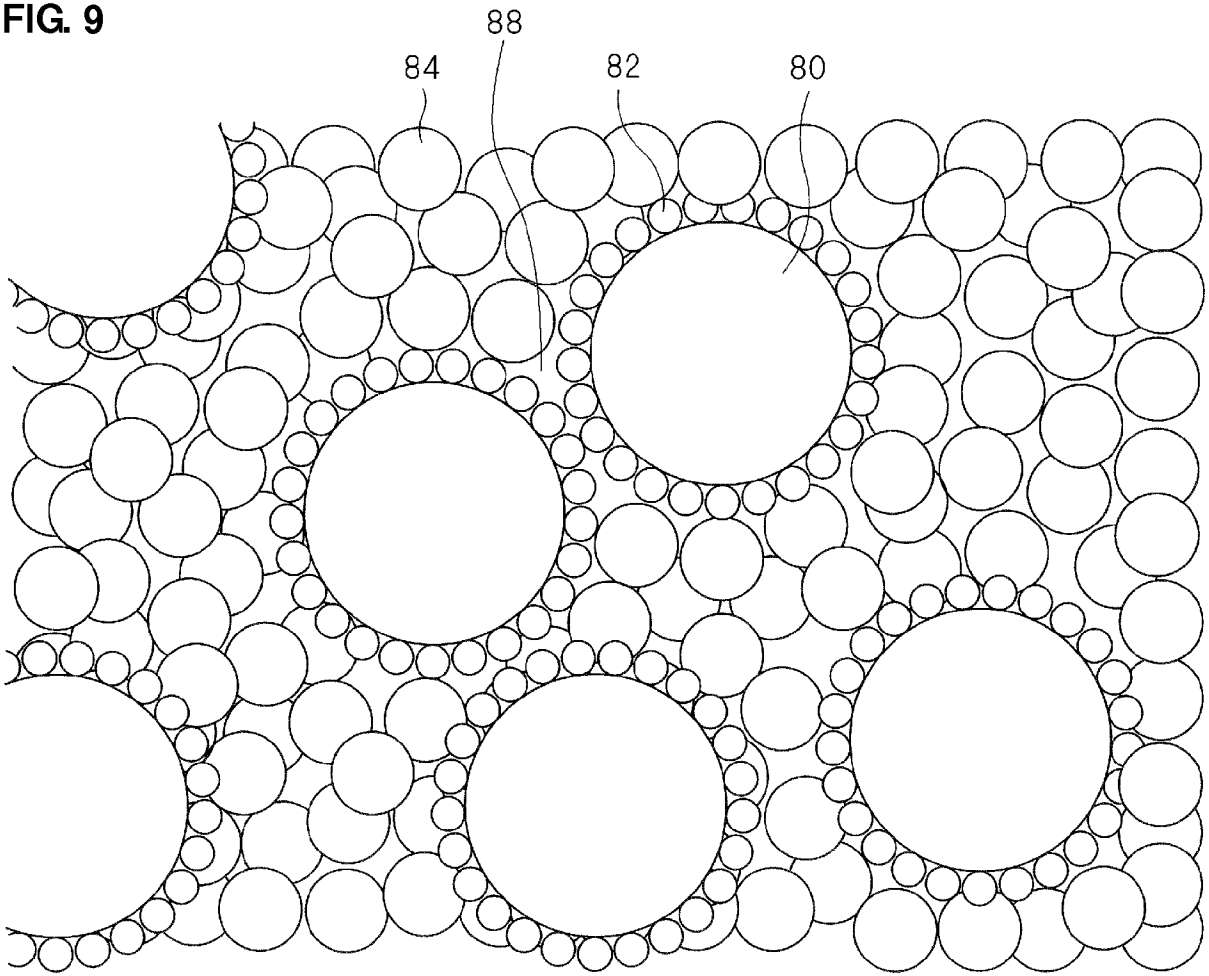
FIG. 9 schematically illustrates the structure of a mixture portion according to the first preferred embodiment of the present invention.

For example, as illustrated in FIG. 9 schematically illustrating the structure of the mixture portion 20, metal material particles 80 coated with inorganic material particles having an insulating property, semiconductor material particles 84, and cavities 88 are dispersed in the mixture portion 20. For example, the metal material particles 80 are Cu particles having a diameter of about 2 μm to about 3 μm; the inorganic material particles 82 are $Al_2O_3$ particles having a diameter of about 1 μm or less; and the semiconductor material particles 84 are composed of silicon carbide, zinc oxide, or the like.

The inorganic material and the semiconductor material may react during firing to exhibit different properties after the firing. The semiconductor material and a ceramic powder forming the ceramic multilayer substrate may also react during firing to exhibit different properties after the firing.

When the metal material is not coated with the inorganic material, metal material particles may be in contact with each other before firing and the connection among the metal material particles may result in a short circuit. In contrast, when the metal material is coated with the inorganic material, metal material particles are not in contact with each other before firing. In addition, even when the inorganic material exhibits different properties after the firing, the state where the metal material particles are separated from each other is maintained. Accordingly, coating of the metal material with the inorganic material significantly decreases the probability that the connection among the metal material particles is formed and a short circuit is caused.

Instead of the metal material coated with the inorganic material, the material for forming the mixture portion may be composed of a metal material and a semiconductor or a ceramic, or a combination of the foregoing. Alternatively, the material for forming the mixture portion may be composed of a semiconductor only without metal materials; a semiconductor and a ceramic only; or a metal material coated with an inorganic material only.

When a voltage of a predetermined value or higher is applied from the outer terminals 14*x* and 16*x* to the ESD protection device 10 illustrated in FIGS. 1 to 3, a discharge is generated, through the mixture portion 20, between the third in-plane connecting conductor 17 and the first and second interlayer connecting conductors 15*a* and 15*x*, the third in-plane connecting conductor 17 opposing the first and second interlayer connecting conductors 15*a* and 15*x*.

The discharge starting voltage can be set at a desired value by adjusting, for example, the peripheral lengths (that is, discharge widths) of portions over which the third connecting conductor 17 opposes the first and second interlayer connecting conductors 15*a* and 15*x* via the mixture portion 20; the radial distances (that is, discharge gaps) between the third connecting conductor 17 and the first and second interlayer connecting conductors 15*a* and 15*x*, the third connecting conductor 17 opposing the first and second interlayer connecting conductors 15*a* and 15*x* via the mixture portion 20; the thickness of the mixture portion 20; or the amounts or types of materials contained in the mixture portion 20.

By connecting the third in-plane connecting conductor 17 to the entirety of the circular outer periphery 20*s* of the mixture portion 20 and by generating a discharge with the circular periphery, the discharge width is increased to facilitate discharging. By forming the mixture portion 20 in the shape of a circle concentric with the third connecting conductor 17 and the first and second interlayer connecting conductors 15*a* and 15*x* serving as discharge electrodes, an ESD discharge portion having a significantly increased size can be formed in a limited area.

As with the first to third in-plane connecting conductors 14, 16, and 17, the mixture portion 20 can be formed by a thick-film printing process, for example. Accordingly, the mixture portion 20 can be easily formed and the thickness thereof can be easily adjusted. Since the mixture portion 20 can be provided along a main surface of a desired insulating layer in the ceramic multilayer substrate, the degree of freedom with which the position of the mixture portion 20 is designed is enhanced.

Since the mixture portion 20 contains not only a metal material but also a semiconductor material, even when the content of the metal material is low, desired ESD responsivity can be obtained. In addition, the occurrence of short circuits due to contact between metal material particles can be significantly reduced and prevented.

The material contained in the mixture portion 20 may include a portion or all of the materials forming the ceramic multilayer substrate 12. When the mixture portion 20 contains the same material as the material of the ceramic multilayer substrate 12, for example, the shrinking behavior of the mixture portion 20 during firing can be easily made to match that of the ceramic multilayer substrate 12. Accordingly, the adhesion of the mixture portion 20 to the ceramic multilayer substrate 12 is enhanced and separation of the mixture portion 20 during firing becomes less likely to occur. In addition, the resistance to repeated ESD is also enhanced. The number of the types of materials used can also be decreased.

The metal material contained in the mixture portion 20 may be the same as or different from the material of the first to third in-plane connecting conductors 14, 16, and 17. When the mixture portion 20 contains the same material as the first to third in-plane connecting conductors 14, 16, and 17, for example, the shrinking behavior of the mixture portion 20 can be easily made to match that of the first to third in-plane connecting conductors 14, 16, and 17, and the number of the types of materials used can be decreased.

A hollow portion may be formed so as to be in contact with the mixture portion 20 and a main surface of the third connecting conductor 17. In this case, by forming the hollow portion, a gaseous discharge can be generated and ESD characteristics can be further enhanced.

Hereinafter, a non-limiting example of a method for producing the ESD protection device 10 will be described.

Ceramic green sheets that have a thickness of 50 μm and are to serve as the first to fourth insulating layers 41 to 44 are first prepared.

A ceramic material that serves as the material of the ceramic multilayer substrate 12 has a composition mainly containing Ba, Al, and Si. Raw materials are prepared and mixed so as to achieve a predetermined composition and calcined at 800° C. to 1000° C. The resultant calcined powder is pulverized with a zirconia-ball mill for 12 hours to provide a ceramic powder. This ceramic powder is mixed with an organic solvent such as toluene or EKINEN, and further mixed with a binder and a plasticizer to provide a slurry. The thus-obtained slurry is formed by the doctor blade technique to provide ceramic green sheets that have a thickness of 50 μm and are to serve as the first to fourth insulating layers 41 to 44.

An electrode paste for forming the first to third in-plane connecting conductors 14, 16, and 17 and the first and second interlayer connecting conductors 15*a* and 15*x* is prepared. A solvent is added to 80 wt % of a Cu powder having an average particle size of about 1.5 μm and a binder resin containing ethyl cellulose or the like. The resultant substance is stirred and mixed with a roll to provide the electrode paste.

A mixture paste for forming the mixture portion 20 is also prepared. The mixture paste is obtained by preparing an $Al_2O_3$-coated Cu powder having an average particle size of about 2 μm and, as a semiconductor material, silicon carbide (SiC) having an average particle size of 1 μm to achieve predetermined proportions; by adding a binder resin and a solvent to the resultant substance; and by stirring and mixing the resultant substance with a roll. The mixture paste contains 20 wt % of the binder resin and the solvent, and the remainder, 80 wt % of the $Al_2O_3$-coated Cu powder and silicon carbide.

In the ceramic green sheets that are to serve as the second and third insulating layers 42 and 43, the via holes 42*p* and 43*p* are formed with laser or a mold. The via holes 42*p* and 43*p* are then filled with the electrode paste by screen printing to form portions that are to serve as the first and second interlayer connecting conductors 15*a* and 15*x*.

The mixture paste is then applied to the ceramic green sheet that is to serve as the third insulating layer 43 by screen printing to form a portion that is to serve as the mixture portion 20. The portion that is to serve as the mixture portion 20 may be formed on the ceramic green sheet that is to serve as the second insulating layer 42.

The electrode paste is then applied to the ceramic green sheets that are to serve as the second and third insulating layers 42 and 43 by screen printing to form portions that are to serve as the first to third in-plane connecting conductors 14, 16, and 17. The portion that is to serve as the first in-plane connecting conductor 14 may be formed on the ceramic green sheet that is to serve as the first insulating layer 41. The portions that are to serve as the second and third in-plane connecting conductors 16 and 17 may be formed on the ceramic green sheet that is to serve as the second insulating layer 42.

After the portions that are to serve as the first to third in-plane connecting conductors 14, 16, and 17 are formed, the portion that is to serve as the mixture portion 20 may be formed.

When a hollow portion is formed so as to be in contact with the mixture portion 20 and a main surface of the third connecting conductor 17, a resin paste that can be eliminated (such as an acrylic paste or a carbon paste) is applied by screen printing onto the previously formed portions that are to serve as the mixture portion 20 and the in-plane connecting conductor 17 such that one of the portions that are to serve as the first and second interlayer connecting conductors 15*a* and 15*x* is exposed.

As with the standard ceramic multilayer substrates, the ceramic green sheets are laminated and press-bonded.

As with chip-type electronic components such as LC filters, the resultant laminated body is cut with a microcutter into chips. After that, the electrode paste is applied to the end surfaces of the chips to form the outer terminals.

As with the standard ceramic multilayer substrates, the chips are then fired in $N_2$ atmosphere. In the case of using an electrode material that is not oxidized (such as Ag), the firing may be performed in the air atmosphere. The firing causes elimination of the organic solvent in the ceramic green sheets and the binder resin and the solvent in the mixture paste. As a result, the mixture portion 20 in which $Al_2O_3$-coated Cu, SiC, and cavities are dispersed is formed.

As with chip-type electronic components such as LC filters, the outer terminals are electrolytically plated with Ni—Sn.

Thus, the ESD protection device 10 having a section illustrated in FIG. 2 has been completed.

The semiconductor material is not particularly limited to the above-described material. Examples of the semiconductor material include semiconductors of metals such as silicon and germanium; carbides such as silicon carbide, titanium carbide, zirconium carbide, molybdenum carbide, and tungsten carbide; nitrides such as titanium nitride, zirconium nitride, chromium nitride, vanadium nitride, and tantalum nitride; silicides such as titanium silicide, zirconium silicide, tungsten silicide, molybdenum silicide, and chromium silicide; borides such as titanium boride, zirconium boride, chromium boride, lanthanum boride, molybdenum boride, and tungsten boride; and oxides such as zinc oxide and strontium titanate. In particular, silicon carbide and zinc oxide are preferred because they are relatively inexpensive and products having various particle sizes are commercially available. Such semiconductor materials may be properly used alone or in combination of two or more thereof. Such a semiconductor material may be properly used in the form of a mixture with a resistive material such as alumina or a BAS material.

The metal material is not particularly limited to the above-described material. Examples of the metal material include Cu, Ag, Pd, Pt, Al, Ni, W, and Mo, alloys of the foregoing, and combinations of the foregoing.

In the first preferred embodiment, the case in which the ESD protection device 10 is a single component having an ESD protection function only (ESD protection device) is described as an example. Alternatively, the ESD protection device may be, for example, a composite component (module) having the ESD protection function and another function. When the ESD protection device is, for example, such a composite component (module), it at least includes the mixture portion 20 and the third in-plane connecting conductor 17 and the first interlayer connecting conductor 15*a* that are connected to the mixture portion 20.

First Modification of First Preferred Embodiment

An ESD protection device 10*a* according to a first modification of the first preferred embodiment of the present invention will be described with reference to FIGS. 4 and 5.

Figure 4:
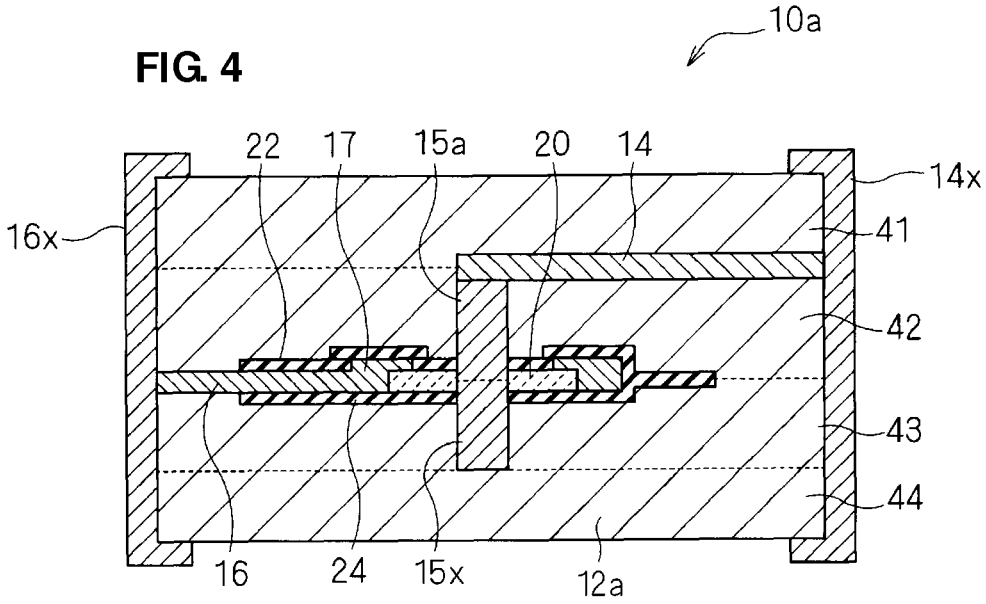
FIG. 4 is a sectional view of an ESD protection device according to a first modification of the first preferred embodiment of the present invention.

FIG. 4 is a sectional view of the ESD protection device 10*a* according to the first modification. As illustrated in FIG. 4, the ESD protection device 10*a* according to the first modification has substantially the same configuration as the ESD protection device 10 according to the first preferred embodiment. Hereinafter, like reference signs in the first preferred embodiment will be used to denote like elements and differences from the first preferred embodiment will be mainly described.

As illustrated in FIG. 4, the ESD protection device 10*a* according to the first modification includes, in addition to the configuration of the first preferred embodiment, sealing layers 22 and 24 disposed between the mixture portion 20 and the second and third insulating layers 42 and 43 of a ceramic multilayer substrate 12*a*. The sealing layers 22 and 24 significantly reduce and prevent permeation of a glass component in the ceramic multilayer substrate 12*a* into the mixture portion 20. The sealing layers 22 and 24 have an insulating property.

As illustrated in sectional views in FIG. 5A to 5D, the sealing layers 22 and 24 can be produced by forming, laminating, press-bonding, and firing the ceramic green sheets that are to serve as the first to fourth insulating layers 41 to 44.

Figure 5A:
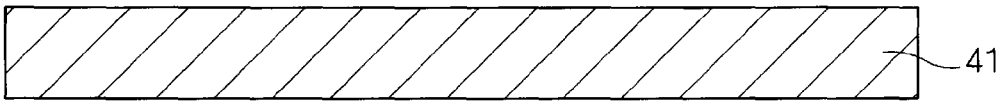
FIGS. 5A-5D include sectional views illustrating steps for producing an ESD protection device according to the first modification of the first preferred embodiment of the present invention.
Figure 5B:
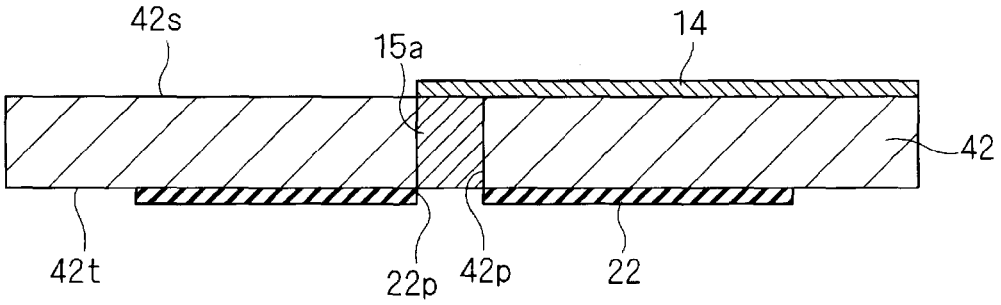
Figure 5C:
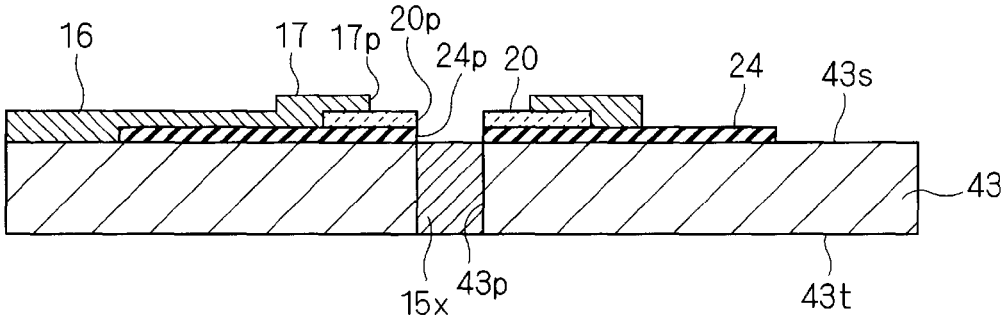
Figure 5D:
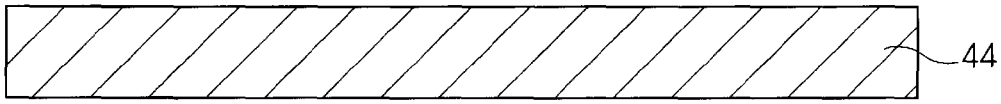

Specifically, as illustrated in FIGS. 5A and 5D, the ceramic green sheets that are to serve as the first and fourth insulating layers 41 and 44 are prepared.

As illustrated in FIGS. 5B and 5C, in the ceramic green sheets that are to serve as the second and third insulating layers 42 and 43, the via holes 42*p* and 43*p* are formed. The via holes 42*p* and 43*p* are filled with the electrode paste to form portions that are to serve as the first and second interlayer connecting conductors 15*a* and 15*x*.

A paste for forming the sealing layers is then applied by screen printing onto opposing surfaces 42*t* and 43*s* of the ceramic green sheets that are to serve as the second and third insulating layers 42 and 43. Thus, the sealing layers 22 and 24 having openings 22*p* and 24*p* are formed. The sealing layers 22 and 24 are then dried. The sealing layers 22 and 24 are formed such that portions that are to serve as the first and second interlayer connecting conductors 15*a* and 15*x* are exposed through the openings 22*p* and 24*p* of the sealing layers 22 and 24.

The mixture portion 20 having the opening 20*p* is then formed from a mixture paste on the sealing layer 24 on the ceramic green sheet that is to serve as the third insulating layer 43. The mixture portion 20 is formed such that the portion that is to serve as the second interlayer connecting conductor 15*x* is exposed through the opening 20*p* of the mixture portion 20. In addition, the portions that are to serve as the second and third in-plane connecting conductors 16 and 17 are formed from an electrode paste on the ceramic green sheet that is to serve as the third insulating layer 43. Alternatively, after the portions that are to serve as the second and third in-plane connecting conductors 16 and 17 are formed on the ceramic green sheet that is to serve as the third insulating layer 43, the portion that is to serve as the mixture portion 20 may be formed.

The sealing layer 22 may be formed on the ceramic green sheet that is to serve as the third insulating layer 43. Specifically, on the ceramic green sheet that is to serve as the third insulating layer 43, after the sealing layer 24, the portion that is to serve as the mixture portion 20, and the portions that are to serve as the second and third in-plane connecting conductors 16 and 17 are formed, the sealing layer 22 may be formed.

On the contrary, on the ceramic green sheet that is to serve as the second insulating layer 42, after the sealing layer 22, the portions that are to serve as the second and third in-plane connecting conductors 16 and 17, and the portion that is to serve as the mixture portion 20 are formed, the sealing layer 24 may be formed.

The paste for forming the sealing layers 22 and 24 is prepared in the same manner as in the electrode paste. For example, a solvent is added to 80 wt % of an $Al_2O_3$ powder having an average particle size of about 1 μm and a binder resin containing ethyl cellulose or the like; the resultant substance is stirred and mixed with a roll to provide the paste (alumina paste) for forming the sealing layers. The solid component of the paste for forming the sealing layers is selected from materials having a higher sintering temperature than the material of the ceramic multilayer substrate, such as alumina, zirconia, magnesia, mullite, and quartz.

When a hollow portion is formed so as to be in contact with the mixture portion 20 and the third in-plane connecting conductor 17, a resin paste that can be eliminated (such as an acrylic paste or a carbon paste) is formed on the third in-plane connecting conductor 17 and the mixture portion 20 that are formed on the ceramic green sheet that is to serve as the third insulating layer 43, such that the portion that is to serve as the second interlayer connecting conductor 15*x* is exposed. By forming the hollow portion, a gaseous discharge can be generated and ESD characteristics can be further enhanced.

Second Modification of First Preferred Embodiment

An ESD protection device 10*b* according to a second modification of the first preferred embodiment of the present invention will be described with reference to FIG. 6.

Figure 6:
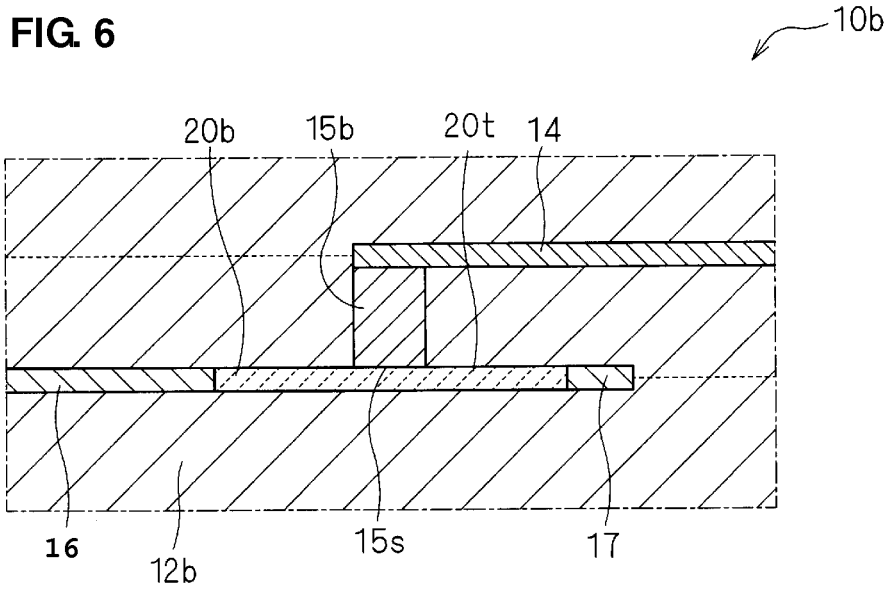
FIG. 6 is a sectional view of a main portion of an ESD protection device according to a second modification of the first preferred embodiment of the present invention.

FIG. 6 is a sectional view of a main portion of the ESD protection device 10*b* according to the second modification. As illustrated in FIG. 6, as in the first preferred embodiment, the ESD protection device 10*b* according to the second modification includes, in a ceramic multilayer substrate 12*b*, the first to third in-plane connecting conductors 14, 16, and 17, an interlayer connecting conductor 15*b* connected to the first in-plane connecting conductor 14, and a mixture portion 20*b*. The third in-plane connecting conductor 17 is connected to the circular outer periphery 20*s* of the mixture portion 20*b*.

Unlike the first preferred embodiment, the opening is not formed in the center of the mixture portion 20*b* and the interlayer connecting conductor 15*b* does not extend through the mixture portion 20*b*. An end surface 15*s* of the interlayer connecting conductor 15*b* in the lamination direction is in contact with an upper surface 20*t* of the mixture portion 20*b* so as to be connected to the central portion of the mixture portion 20*b*.

A hollow portion may be formed on the upper surface 20*t* side of the mixture portion 20*b* so as to be in contact with the mixture portion 20*b*, a main surface of the third in-plane connecting conductor 17, and the side surface of the interlayer connecting conductor 15*b*. By forming the hollow portion, a gaseous discharge can be generated and ESD characteristics can be further enhanced.

Third Modification of First Preferred Embodiment

An ESD protection device 10*c* according to a third modification of the first preferred embodiment of the present invention will be described with reference to FIG. 7.

Figure 7:
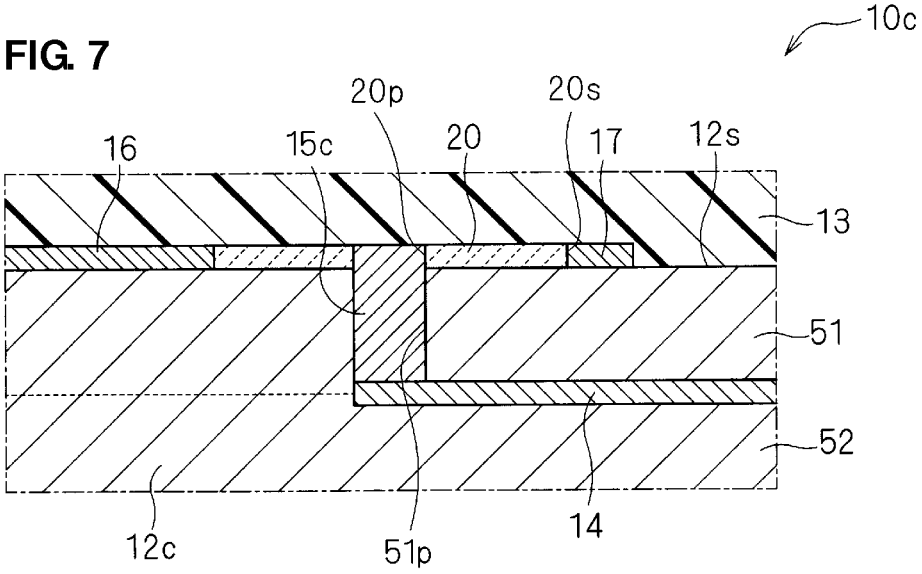
FIG. 7 is a sectional view of a main portion of an ESD protection device according to a third modification of the first preferred embodiment of the present invention.

FIG. 7 is a sectional view of a main portion of the ESD protection device 10*c* according to the third modification. As illustrated in FIG. 7, the ESD protection device 10*c* according to the third modification has substantially the same configuration as in the first preferred embodiment.

Unlike the first preferred embodiment, in the ESD protection device 10*c* according to the third modification, the mixture portion 20, the third in-plane connecting conductor 17 connected to the outer periphery 20*s* of the mixture portion 20, and the second in-plane connecting conductor 16 connected to the third in-plane connecting conductor 17 are formed on a surface 12*s* of a ceramic multilayer substrate 12*c*. The outer periphery of an end (in the lamination direction) of the interlayer connecting conductor 15*c* formed in a via hole 51*p* in the outermost insulating layer 51 is connected to the periphery of the opening 20*p* in the central portion of the mixture portion 20. The other end (in the lamination direction) of the interlayer connecting conductor 15*c* is connected to the first in-plane connecting conductor 14 formed between the insulating layers 51 and 52, which are next to each other.

When a voltage higher than a predetermined value is applied between the interlayer connecting conductor 15*c* and the third in-plane connecting conductor 17 through the first and second in-plane connecting conductors 14 and 16, a discharge is generated, through the mixture portion 20, between the interlayer connecting conductor 15*c* and the third in-plane connecting conductor 17.

Since the mixture portion 20 and the second and third in-plane connecting conductors 16 and 17 are formed on the surface 12*s* of the ceramic multilayer substrate 12*c*, they are preferably covered with a cover layer 13 having an insulating property. Instead of the cover layer 13, cover members that are separated from each other and cover the mixture portion 20 and the second and third in-plane connecting conductors 16 and 17 may be formed on the ceramic multilayer substrate 12*c*.

In FIG. 7, a hollow portion may be formed so as to be in contact with the mixture portion 20 and the main surface 12*s* (on the insulating layer 51 side) or a main surface (on the cover layer 13 side) of the third in-plane connecting conductor 17. By forming the hollow portion, a gaseous discharge can be generated and ESD characteristics can be further enhanced.

Fourth Modification of First Preferred Embodiment

An ESD protection device 10*d* according to a fourth modification of the first preferred embodiment of the present invention will be described with reference to FIGS. 8A and 8B.

Figure 8A:
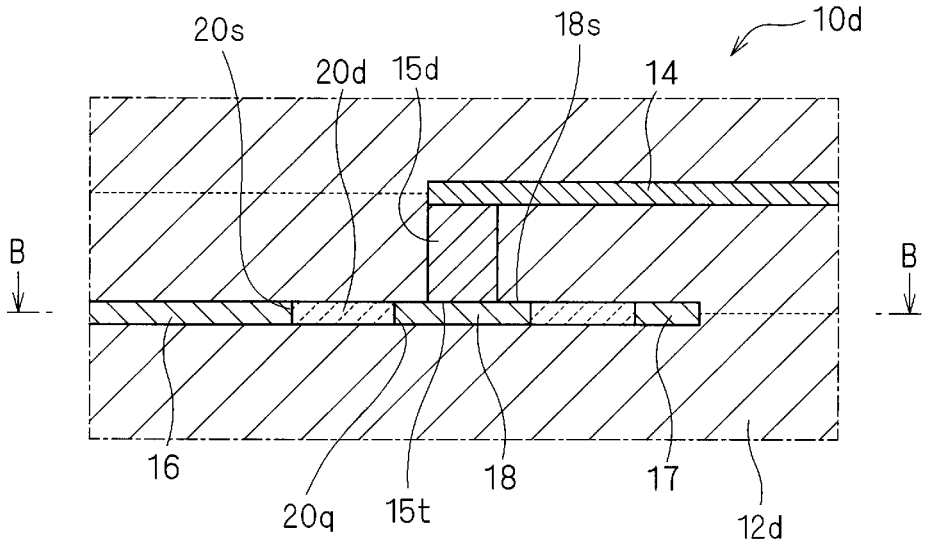
FIGS. 8A and 8B include sectional views of a main portion of an ESD protection device according to a fourth modification of the first preferred embodiment of the present invention.
Figure 8B:
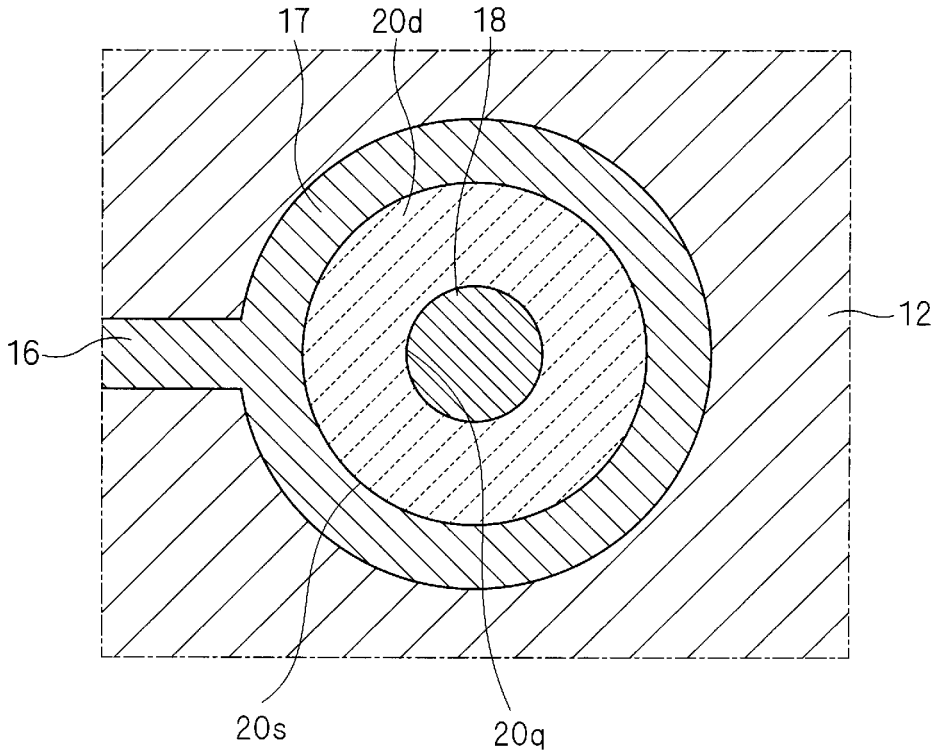

FIG. 8A is a sectional view of a main portion of the ESD protection device 10*d* according to the fourth modification. FIG. 8B is a sectional view taken along line B-B in FIG. 8A. As illustrated in FIGS. 8A and 8B, as in the first preferred embodiment, the ESD protection device 10*d* according to the fourth modification includes, between neighboring insulating layers in a ceramic multilayer substrate 12*d*, a mixture portion 20*d* having an outer periphery 20*s* that is circular, the third in-plane connecting conductor 17 connected to the outer periphery 20*s* of the mixture portion 20*d*, and the second in-plane connecting conductor 16 connected to the third in-plane connecting conductor 17.

Unlike the first preferred embodiment, in the ESD protection device 10*d* according to the fourth modification, a fourth in-plane connecting conductor 18 is formed in an opening 20*q* formed in a central portion of the mixture portion 20*d*. The outer periphery of the fourth in-plane connecting conductor 18 is connected to the periphery of the opening 20*q* of the mixture portion 20*d*. An upper surface 18*s* of the fourth in-plane connecting conductor 18 is connected to an end surface 15*t* (in the lamination direction) of an interlayer connecting conductor 15*d*. The other end (in the lamination direction) of the interlayer connecting conductor 15*d* is connected to the first in-plane connecting conductor 14. The interlayer connecting conductor 15*d* serves as a first connecting conductor. The fourth in-plane connecting conductor 18 serves as a third connecting conductor.

When a voltage higher than a predetermined value is applied between the third and fourth in-plane connecting conductors 17 and 18 through the first and second in-plane connecting conductors 14 and 16, a discharge is generated, through the mixture portion 20*d*, between the third and fourth in-plane connecting conductors 17 and 18.

In the ESD protection device 10*d*, while sufficiently large peripheral lengths (discharge widths) of portions over which the third and fourth in-plane connecting conductors 17 and 18 oppose each other via the mixture portion 20*d* are maintained, the radial distance (discharge gap) between the third and fourth in-plane connecting conductors 17 and 18 can be decreased.

In this case, a hollow portion may be formed so as to be in contact with the mixture portion 20*d* and a main surface of the third and fourth in-plane connecting conductors 17 and 18. By forming the hollow portion, a gaseous discharge can be generated and ESD characteristics can be further enhanced.

Second Preferred Embodiment

An ESD protection device 110*x* according to a second preferred embodiment of the present invention will be described with reference to FIG. 10.

Figure 10:
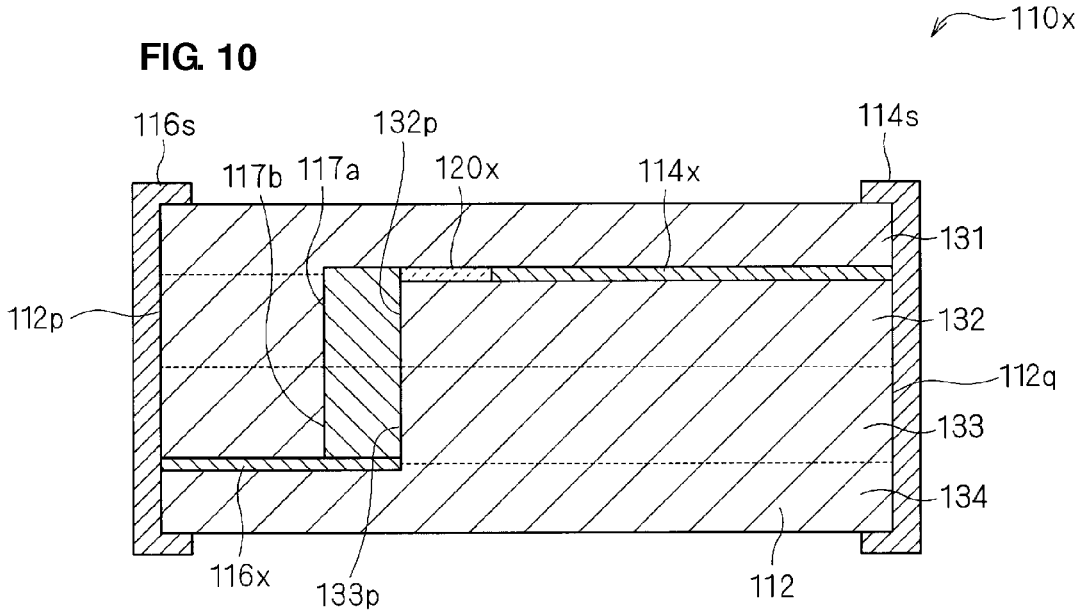
FIG. 10 is a sectional view of an ESD protection device according to a second preferred embodiment of the present invention.

FIG. 10 is a sectional view of the ESD protection device 110*x*. As illustrated in FIG. 10, the ESD protection device 110*x* includes a ceramic multilayer substrate 112 in which first to fourth insulating layers 131 to 134 composed of a ceramic material are laminated. The ceramic multilayer substrate 112 includes a mixture portion 120*x*, first and second in-plane connecting conductors 114*x* and 116*x*, and first and second interlayer connecting conductors 117*a* and 117*b*.

In the second and third insulating layers 132 and 133, via holes (through holes) 132*p* and 133*p* extending through the upper and lower main surfaces of the second and third insulating layers 132 and 133 are formed. In the via holes 132*p* and 133*p*, the first and second interlayer connecting conductors 117*a* and 117*b* are respectively formed. In the first and second interlayer connecting conductors 117*a* and 117*b*, opposing end surfaces thereof are joined together.

The mixture portion 120*x* is arranged along the upper main surface of the second insulating layer 132 including the first interlayer connecting conductor 117*a* and is connected to the first interlayer connecting conductor 117*a*. The first interlayer connecting conductor 117*a* serves as a first connecting conductor.

The first in-plane connecting conductor 114*x* is arranged along the upper main surface of the second insulating layer 132 including the first interlayer connecting conductor 117*a*. The first in-plane connecting conductor 114*x* is connected to the mixture portion 120*x*. The first in-plane connecting conductor 114*x* serves as a second connecting conductor. The first in-plane connecting conductor 114*x* is arranged so as to extend to a side surface 112*q* of the ceramic multilayer substrate 112.

Instead of the first in-plane connecting conductor 114*x*, the second connecting conductor connected to the mixture portion 120*x* may be an interlayer connecting conductor arranged so as to extend through the main surfaces of one of the first and second insulating layers 131 and 132 (not shown). As in FIG. 12 described below, the end portions of the mixture portion 120*x* may be connected to the first interlayer connecting conductor 117*a* and the first in-plane connecting conductor 114*x* so as to overlap an end surface of the first interlayer connecting conductor 117*a* and an end portion of the first in-plane connecting conductor 114*x*.

The second in-plane connecting conductor 116*x* is disposed between the third and fourth insulating layers 133 and 134 so as to extend along opposing main surfaces of the third and fourth insulating layers 133 and 134. The second in-plane connecting conductor 116*x* is connected to the second interlayer connecting conductor 117*b*. The second in-plane connecting conductor 116*x* is arranged so as to extend to another side surface 112*p* of the ceramic multilayer substrate 112.

Outer terminals 116*s* and 114*s* are respectively disposed on the side surfaces 112*p* and 112*q* of the ceramic multilayer substrate 112. One of the outer terminals, 116*s*, is connected to the second in-plane connecting conductor 116*x*. The other one of the outer terminals, 114*s*, is connected to the first in-plane connecting conductor 114*x*.

The first and second in-plane connecting conductors 114*x* and 116*x*, the first and second interlayer connecting conductors 117*a* and 117*b*, and the first and second outer terminals 114*s* and 116*s* have electrical conductivity.

In the mixture portion 120*x*, a material is dispersed, the material containing at least one selected from (i) a metal and a semiconductor, (ii) a metal and a ceramic, (iii) a metal, a semiconductor, and a ceramic, (iv) a semiconductor and a ceramic, (v) a semiconductor, (vi) a metal coated with an inorganic material, (vii) a metal coated with an inorganic material and a semiconductor, (viii) a metal coated with an inorganic material and a ceramic, and (ix) a metal coated with an inorganic material, a semiconductor, and a ceramic. The mixture portion 120*x* has an insulating property on the whole.

The ESD protection device 110*x* includes, as an interlayer connecting conductor, at least one of the discharge electrodes 114*x* and 117*a* that are disposed with the mixture portion 120*x* therebetween, that is, 117*a*. As a result, heat generated at the time of the application of static electricity can be dissipated through the interlayer connecting conductor having a higher thermal conductivity than in-plane connecting conductors. Thus, a temperature increase due to repeated discharge can be significantly reduced and prevented and melting of the discharge electrodes can be significantly reduced and prevented. In this case, by connecting the outer terminal 116*s*, which is close to the interlayer connecting conductor 117*a*, to the ground, a heat dissipation property can be enhanced. In addition, since the mixture portion can be disposed at a desired position in the lamination direction with respect to the interlayer connecting conductor, the degree of freedom in design can be enhanced.

Third Preferred Embodiment

An ESD protection device 110 according to a third preferred embodiment will be described with reference to FIGS. 11 to 13.

Figure 11:
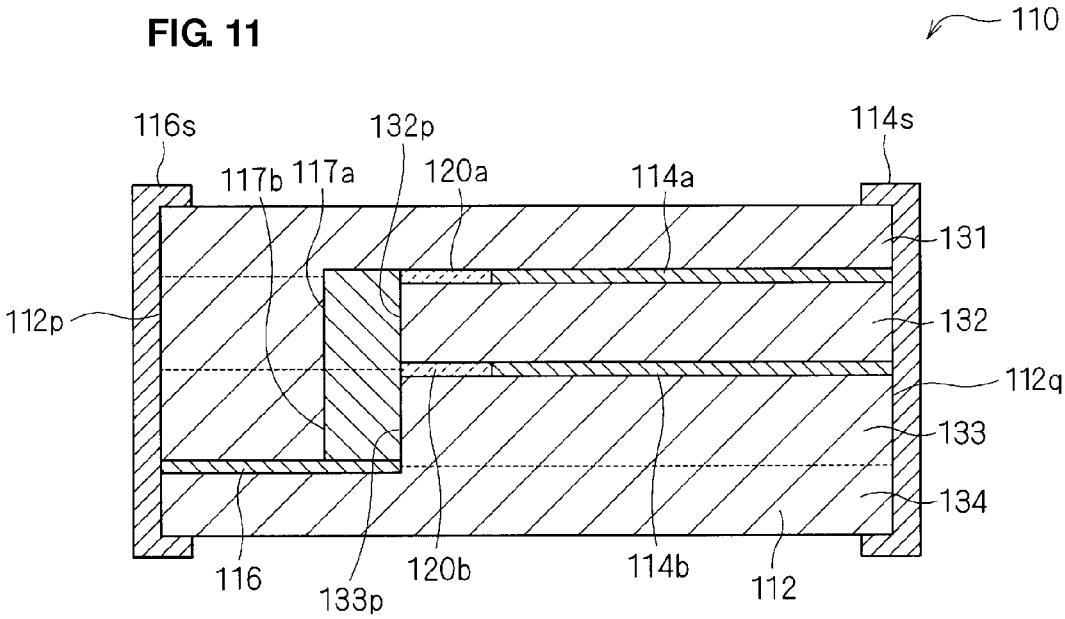
FIG. 11 is a sectional view of an ESD protection device according to a third preferred embodiment of the present invention.
Figure 12:
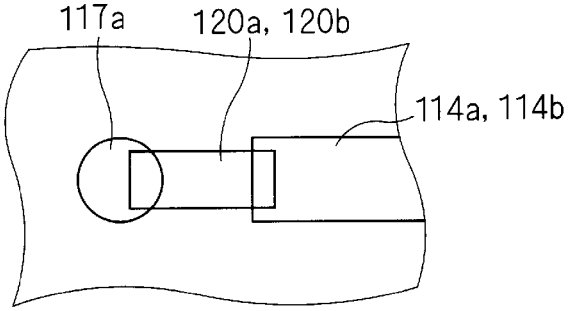
FIG. 12 is a sectional view of an ESD protection device according to a modification of the third preferred embodiment of the present invention.

FIG. 11 is a sectional view of the ESD protection device 110. As illustrated in FIG. 11, the ESD protection device 110 includes a ceramic multilayer substrate 112 in which first to fourth insulating layers 131 to 134 composed of a ceramic material are laminated. The ceramic multilayer substrate 112 includes mixture portions 120*a* and 120*b*, first to third in-plane connecting conductors 114*a*, 114*b*, and 116, and first and second interlayer connecting conductors 117*a* and 117*b*.

In the second and third insulating layers 132 and 133, via holes (through holes) 132*p* and 133*p* extending through the upper and lower main surfaces of the second and third insulating layers 132 and 133 are formed. In the via holes 132*p* and 133*p*, the first and second interlayer connecting conductors 117*a* and 117*b* are respectively provided. In the first and second interlayer connecting conductors 117*a* and 117*b*, opposing end surfaces thereof are joined together.

The first and second mixture portions 120*a* and 120*b* are respectively arranged along the upper and lower main surfaces of the second insulating layer 132 including the first interlayer connecting conductor 117*a* and are connected to the first interlayer connecting conductor 117*a*. The first interlayer connecting conductor 117*a* serves as a first connecting conductor.

The first and second in-plane connecting conductors 114*a* and 114*b* are respectively arranged along the upper and lower main surfaces of the second insulating layer 132 including the first interlayer connecting conductor 117*a*. The first and second in-plane connecting conductors 114*a* and 114*b* are respectively connected to the first and second mixture portions 120*a* and 120*b*. The first and second in-plane connecting conductors 114*a* and 114*b* serve as a second connecting conductor. The first and second in-plane connecting conductors 114*a* and 114*b* are arranged to extend to a side surface 112*q* of the ceramic multilayer substrate 112.

Instead of the first in-plane connecting conductor 114*a*, the second connecting conductor connected to the first mixture portion 120*a* may be an interlayer connecting conductor arranged so as to extend through the main surfaces of one of the first and second insulating layers 131 and 132 (not shown). Instead of the second in-plane connecting conductor 114*b*, the second connecting conductor connected to the second mixture portion 120*b* may be an interlayer connecting conductor arranged so as to extend through the main surfaces of one of the second and third insulating layers 132 and 133.

The third in-plane connecting conductor 116 is provided between the third and fourth insulating layers 133 and 134 so as to extend along opposing main surfaces of the third and fourth insulating layers 133 and 134. The third in-plane connecting conductor 116 is connected to the second interlayer connecting conductor 117*b*. The third in-plane connecting conductor 116 is arranged so as to extend to another side surface 112*p* of the ceramic multilayer substrate 112.

Outer terminals 114*s* and 116*s* are respectively provided on the side surfaces 112*q* and 112*p* of the ceramic multilayer substrate 112. One of the outer terminals, 116*s*, is connected to the third in-plane connecting conductor 116. The other one of the outer terminals, 114*s*, is connected to the first and second in-plane connecting conductors 114*a* and 114*b*.

FIG. 11 illustrates, as an example, the case where both ends of the first and second mixture portions 120*a* and 120*b* are connected to the first interlayer connecting conductor 117*a* and the first and second in-plane connecting conductors 114*a* and 114*b* so as to be in contact with the outer periphery of the first interlayer connecting conductor 117*a* and ends of the first and second in-plane connecting conductors 114*a* and 114*b*. Alternatively, as illustrated in a perspective view of FIG. 12, the end portions of the first and second mixture portions 120*a* and 120*b* may be connected to the first interlayer connecting conductor 117*a* and the first and second in-plane connecting conductors 114*a* and 114*b* so as to overlap an end surface of the first interlayer connecting conductor 117*a* and end portions of the first and second in-plane connecting conductors 114*a* and 114*b*.

The first to third in-plane connecting conductors 114*a*, 114*b*, and 116, the first and second interlayer connecting conductors 117*a* and 117*b*, and the first and second outer terminals 114*s* and 116*s* have electrical conductivity.

In the mixture portions 120*a* and 120*b*, a material is dispersed, the material containing at least one selected from (i) a metal and a semiconductor, (ii) a metal and a ceramic, (iii) a metal, a semiconductor, and a ceramic, (iv) a semiconductor and a ceramic, (v) a semiconductor, (vi) a metal coated with an inorganic material, (vii) a metal coated with an inorganic material and a semiconductor, (viii) a metal coated with an inorganic material and a ceramic, and (ix) a metal coated with an inorganic material, a semiconductor, and a ceramic. The mixture portions 120*a* and 120*b* have an insulating property on the whole.

Figure 13:
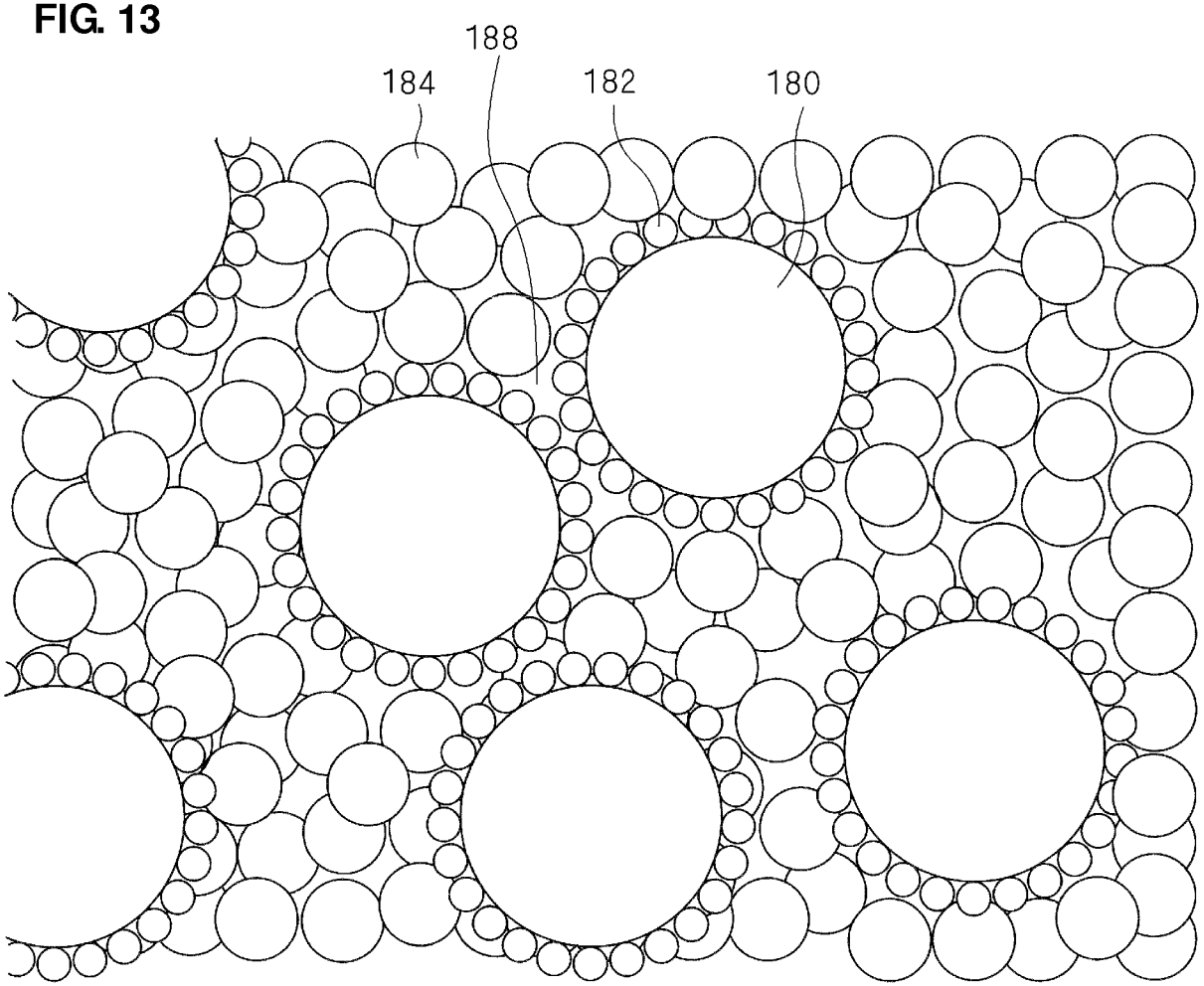
FIG. 13 schematically illustrates the structure of a mixture portion according to the third preferred embodiment of the present invention.

For example, as illustrated in FIG. 13 schematically illustrating the structure of the mixture portions 120*a* and 120*b*, metal material particles 180 coated with inorganic material particles 182 having an insulating property, semiconductor material particles 184, and cavities 188 are dispersed in the mixture portions 120*a* and 120*b*. For example, the metal material particles 180 are Cu particles having a diameter of about 2 μm to about 3 μm; the inorganic material particles 182 are $Al_2O_3$ particles having a diameter of about 1 μm or less; and the semiconductor material particles 184 are composed of silicon carbide, zinc oxide, or the like.

The inorganic material and the semiconductor material may react during firing to exhibit different properties after the firing. The semiconductor material and a ceramic powder of the ceramic multilayer substrate may also react during firing to exhibit different properties after the firing.

When the metal material is not coated with the inorganic material, metal material particles may be in contact with each other before firing and connection among the metal material particles may result in a short circuit. In contrast, when the metal material is coated with the inorganic material, metal material particles are not in contact with each other before firing. In addition, even when the inorganic material exhibits different properties after the firing, the state where the metal material particles are separated from each other is maintained. Accordingly, coating of the metal material with the inorganic material significantly decreases the probability that the connection among the metal material particles is formed and a short circuit is caused.

Instead of the metal material coated with the inorganic material, the material for forming the mixture portions may be composed of a metal material and a semiconductor or a ceramic, or a combination of the foregoing. Alternatively, the material for forming the mixture portions may be composed of a semiconductor only without metal materials; a semiconductor and a ceramic only; or a metal material coated with an inorganic material only.

When a voltage of a predetermined value or higher is applied from the outer terminals 114*s* and 116*s* to the ESD protection device 110 illustrated in FIG. 11, a discharge is generated, through the mixture portions 120*a* and 120*b*, between the interlayer connecting conductor 117*a* and the first and second in-plane connecting conductors 114*a* and 114*b*.

The discharge starting voltage can be set at a desired value by adjusting, for example, the lengths (that is, discharge widths) of portions over which the first interlayer connecting conductor 117*a* opposes the first and second in-plane connecting conductors 114*a* and 114*b* via the first and second mixture portions 120*a* and 120*b*; the distances (that is, discharge gaps) between the interlayer connecting conductor 117*a* and the first and second in-plane connecting conductors 114*a* and 114*b*, the interlayer connecting conductor 117*a* opposing the first and second in-plane connecting conductors 114*a* and 114*b* via the mixture portions 120*a* and 120*b*; the thickness of the mixture portions 120*a* and 120*b*; or the amounts or types of materials contained in the mixture portions 120*a* and 120*b*.

The first and second mixture portions 120*a* and 120*b* are connected in parallel between the first and second in-plane connecting conductors 114*a* and 114*b* and the first interlayer connecting conductor 117*a*. Accordingly, even when one of the first and second mixture portions 120*a* and 120*b* fails, the other one works. Thus, the reliability of the ESD protection function can be enhanced.

A hollow may be formed so as to be in contact with the mixture portions 120*a* and 120*b*, a main surface of the first in-plane connecting conductor 114*a*, a main surface of the second in-plane connecting conductor 114*b*, and the outer periphery or an end surface of the first interlayer connecting conductor 117*a*. By forming the hollows, a gaseous discharge can be generated and ESD characteristics can be further enhanced.

As with the in-plane connecting conductors 114*a*, 114*b*, and 116, the first and second mixture portions 120*a* and 120*b* can be formed by a thick-film printing process, for example. Accordingly, the first and second mixture portions 120*a* and 120*b* can be easily formed and the thickness thereof can be easily adjusted. Since the first and second mixture portions 120*a* and 120*b* can be formed along main surfaces of desired insulating layers in the ceramic multilayer substrate, the degree of freedom with which the positions of the mixture portions 120*a* and 120*b* are designed is enhanced.

Since the first and second mixture portions 120*a* and 120*b* contain not only a metal material but also a semiconductor material, even when the content of the metal material is low, desired ESD responsivity can be obtained. In addition, the occurrence of short circuits due to contact between metal material particles can be significantly reduced and prevented.

The material contained in the first and second mixture portions 120*a* and 120*b* may include a portion or all of the materials forming the ceramic multilayer substrate 112. When the first and second mixture portions 120*a* and 120*b* contain the same material as the ceramic multilayer substrate 112, for example, the shrinking behavior of the first and second mixture portions 120*a* and 120*b* during firing can be easily made to match that of the ceramic multilayer substrate 112. Accordingly, the adhesion of the first and second mixture portions 120*a* and 120*b* to the ceramic multilayer substrate 112 is enhanced and separation of the first and second mixture portions 120*a* and 120*b* during firing becomes less likely to occur. In addition, the resistance to repeated ESD is also enhanced. The number of the types of materials used can also be decreased.

The metal material contained in the first and second mixture portions 120*a* and 120*b* may be the same as or different from the material of the first to third in-plane connecting conductors 114*a*, 114*b*, and 116. When the first and second mixture portions 120*a* and 120*b* contain the same material as the first to third in-plane connecting conductors 114*a*, 114*b*, and 116, for example, the shrinking behavior of the first and second mixture portions 120*a* and 120*b* can be easily made to match that of the first to third in-plane connecting conductors 114*a*, 114*b*, and 116, and the number of the types of materials used can be decreased.

Hereinafter, a non-limiting example of a method for producing the ESD protection device 110 will be described.

Ceramic green sheets that are to serve as the first to fourth insulating layers 131 to 134 of the ceramic multilayer substrate 112 are prepared. A ceramic material that serves as the material of the ceramic multilayer substrate 112 has a composition mainly containing Ba, Al, and Si. Raw materials are prepared and mixed so as to achieve a predetermined composition and calcined at 800° C. to 1000° C. The resultant calcined powder is pulverized with a zirconia-ball mill for 12 hours to provide a ceramic powder. This ceramic powder is mixed with an organic solvent such as toluene or EKINEN, and further mixed with a binder and a plasticizer to provide a slurry. The thus-obtained slurry is formed by the doctor blade technique to provide ceramic green sheets that have a thickness of 50 μm and are to serve as the first to fourth insulating layers 131 to 134.

An electrode paste for forming the first to third in-plane connecting conductors 114*a*, 114*b*, and 116 and the first and second interlayer connecting conductors 117*a* and 117*b* is also prepared. A solvent is added to 80 wt % of a Cu powder having an average particle size of about 1.5 μm and a binder resin containing ethyl cellulose or the like. The resultant substance is stirred and mixed with a roll to provide the electrode paste.

A mixture paste for forming the first and second mixture portions 120*a* and 120*b* is also prepared. The mixture paste is obtained by preparing an $Al_2O_3$-coated Cu powder having an average particle size of about 2 μm and, as a semiconductor material, silicon carbide (SiC) having an average particle size of 1 μm to achieve predetermined proportions; by adding a binder resin and a solvent to the resultant substance; and by stirring and mixing the resultant substance with a roll. The mixture paste contains 20 wt % of the binder resin and the solvent, and the remainder, 80 wt % of the $Al_2O_3$-coated Cu powder and silicon carbide.

In the ceramic green sheets that are to serve as the second and third insulating layers 132 and 133, via holes are formed so as to extend through the main surfaces of the ceramic green sheets with laser or a mold. The via holes are then filled with the mixture paste by screen printing to form portions that are to serve as the first and second interlayer connecting conductors 117*a* and 117*b*.

The mixture paste is then applied to the ceramic green sheets that are to serve as the second and third insulating layers 132 and 133 by screen printing to form portions that are to serve as the first and second mixture portions 120*a* and 120*b*. The portion that is to serve as the first mixture portion 120*a* may be formed on the ceramic green sheet that is to serve as the first insulating layer 131. The portion that is to serve as the second mixture portion 120*b* may be formed on the ceramic green sheet that is to serve as the second insulating layer 132.

The electrode paste is then applied to the ceramic green sheets that are to serve as the second to fourth insulating layers 132, 133, and 134 by screen printing to form portions that are to serve as the first to third in-plane connecting conductors 114*a*, 114*b*, and 116. The portion that is to serve as the first in-plane connecting conductor 114*a* may be formed on the ceramic green sheet that is to serve as the first insulating layer 131. The portion that is to serve as the second in-plane connecting conductor 114*b* may be formed on the ceramic green sheet that is to serve as the second insulating layer 132. The portion that is to serve as the third in-plane connecting conductor 116 may be formed on the ceramic green sheet that is to serve as the third insulating layer 133.

After the portions that are to serve as the first to third in-plane connecting conductors 114*a*, 114*b*, and 116 are formed, the portions that are to serve as the first and second mixture portions 120*a* and 120*b* may be formed.

When a hollow is formed so as to be in contact with the mixture portions 120*a* and 120*b*, a main surface of the first in-plane connecting conductor 114*a*, a main surface of the second in-plane connecting conductor 114*b*, and the outer periphery or an end surface of the first interlayer connecting conductor 117*a*, a resin paste that can be eliminated (such as an acrylic paste or a carbon paste) is applied by screen printing onto the previously formed portions that are to serve as the mixture portions 120*a* and 120*b* and the in-plane connecting conductors 114*a* and 114*b*.

As with the standard ceramic multilayer substrates, the ceramic green sheets are laminated and press-bonded.

As with chip-type electronic components such as LC filters, the resultant laminated body is cut with a microcutter into chips. After that, the electrode paste is applied to the end surfaces of the chips to form the outer terminals.

As with the standard ceramic multilayer substrates, the chips are then fired in $N_2$ atmosphere. In the case of using an electrode material that is not oxidized (such as Ag), the firing may be performed in the air atmosphere. The firing causes elimination of the organic solvent in the ceramic green sheets and the binder resin and the solvent in the mixture paste. As a result, the first and second mixture portions 120*a* and 120*b* in which $Al_2O_3$-coated Cu, SiC, and cavities are dispersed are formed.

As with chip-type electronic components such as LC filters, the outer terminals are electrolytically plated with Ni—Sn.

Thus, the ESD protection device 110 having a section illustrated in FIG. 11 has been completed.

The semiconductor material is not particularly limited to the above-described material. Examples of the semiconductor material include semiconductors of metals such as silicon and germanium; carbides such as silicon carbide, titanium carbide, zirconium carbide, molybdenum carbide, and tungsten carbide; nitrides such as titanium nitride, zirconium nitride, chromium nitride, vanadium nitride, and tantalum nitride; silicides such as titanium silicide, zirconium silicide, tungsten silicide, molybdenum silicide, and chromium silicide; borides such as titanium boride, zirconium boride, chromium boride, lanthanum boride, molybdenum boride, and tungsten boride; and oxides such as zinc oxide and strontium titanate. In particular, silicon carbide and zinc oxide are preferred because they are relatively inexpensive and products having various particle sizes are commercially available. Such semiconductor materials may be properly used alone or in combination of two or more thereof. Such a semiconductor material may be properly used in the form of a mixture with an insulating material such as alumina or a BAS material.

The metal material is not particularly limited to the above-described material. Examples of the metal material include Cu, Ag, Pd, Pt, Al, Ni, W, and Mo, alloys of the foregoing, and combinations of the foregoing.

Fourth Preferred Embodiment

An ESD protection device 110*a* according to a fourth preferred embodiment will be described with reference to FIGS. 14 and 15.

Figure 14:
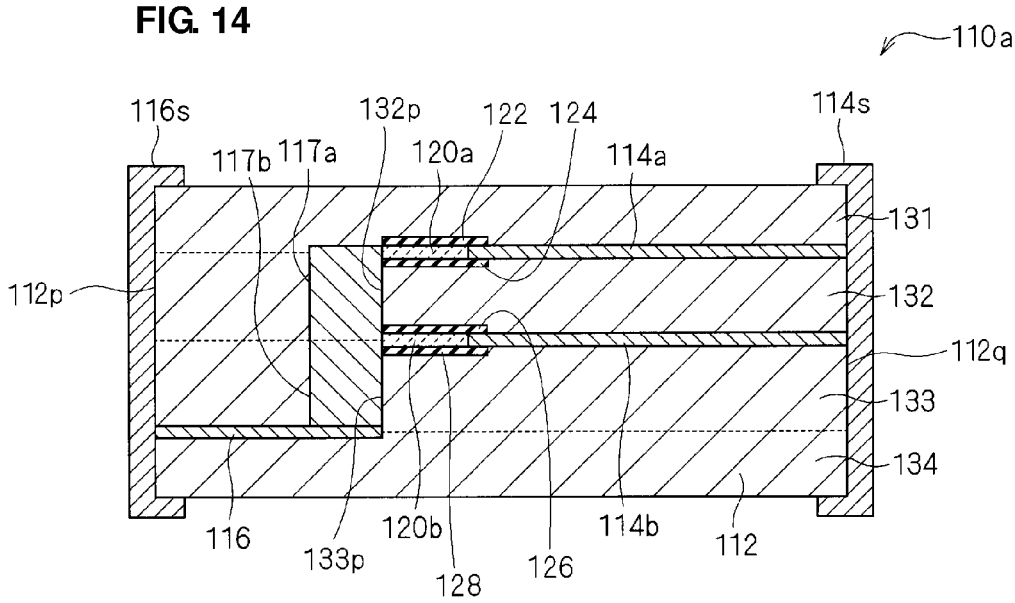
FIG. 14 is a sectional view of an ESD protection device according to a fourth preferred embodiment of the present invention.

FIG. 14 is a sectional view of the ESD protection device 110*a* according to the fourth preferred embodiment. As illustrated in FIG. 14, the ESD protection device 110*a* according to the fourth preferred embodiment has substantially the same configuration as the ESD protection device 110 according to the third preferred embodiment. Hereinafter, like reference signs in the third preferred embodiment will be used to denote like elements and differences from the third preferred embodiment will be mainly described.

As illustrated in FIG. 14, the ESD protection device 110*a* according to the fourth preferred embodiment includes, in addition to the configuration of the third preferred embodiment, sealing layers 122 and 124 disposed between the first mixture portion 120*a* and the first and second insulating layers 131 and 132, and sealing layers 126 and 128 disposed between the second mixture portion 120*b* and the second and third insulating layers 132 and 133. The sealing layers 122, 124, 126, and 128 significantly reduce and prevent permeation of a glass component in the ceramic multilayer substrate 112 into the first and second mixture portions 120*a* and 120*b*. Each of the sealing layers 122, 124, 126, and 128 has an insulating property.

As illustrated in sectional views in FIG. 15A to 15Dd, such a configuration can be produced by forming, laminating, press-bonding, and firing the ceramic green sheets that are to serve as the first to fourth insulating layers 131 to 134.

Figure 15A:
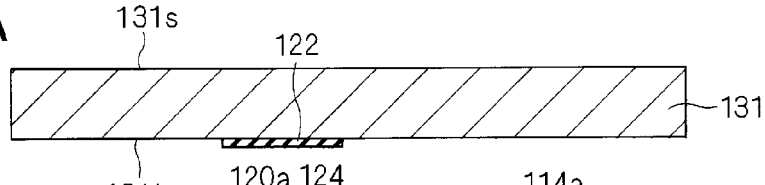
FIGS. 15A-15D include sectional views illustrating steps for producing an ESD protection device according to the fourth preferred embodiment of the present invention.
Figure 15B:
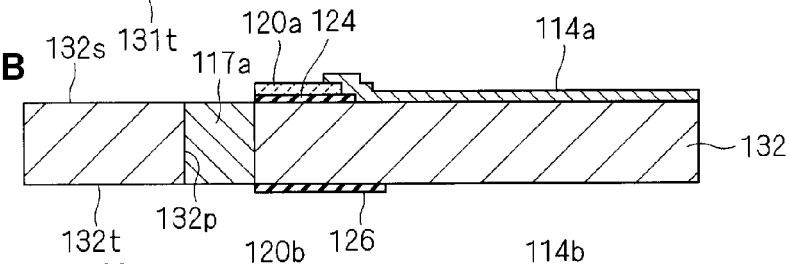
Figure 15C:
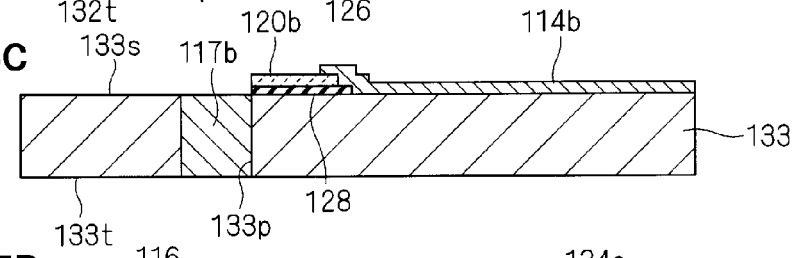

As illustrated in FIGS. 15B and 15C, in the ceramic green sheets that are to serve as the second and third insulating layers 132 and 133, the via holes 132*p* and 133*p* are formed. The via holes 132*p* and 133*p* are filled with the electrode paste to form portions that are to serve as the first and second interlayer connecting conductors 117*a* and 117*b*.

Subsequently, as illustrated in FIG. 15A to 15C, a paste for forming the sealing layers is applied by screen printing and then dried. Thus, the sealing layers 122, 124, 126, and 128 are formed on opposing surfaces 131*t*, 132*s*, 132*t*, and 133*s* of the ceramic green sheets that are to serve as the first to third insulating layers 131 to 133.

Subsequently, as illustrated in FIGS. 15B and 15C, the mixture paste is applied by screen printing onto the sealing layers 124 and 128 on the ceramic green sheets that are to serve as the second and third insulating layers 132 and 133, to thereby form portions that are to serve as the first and second mixture portions 120*a* and 120*b*.

Figure 15D:
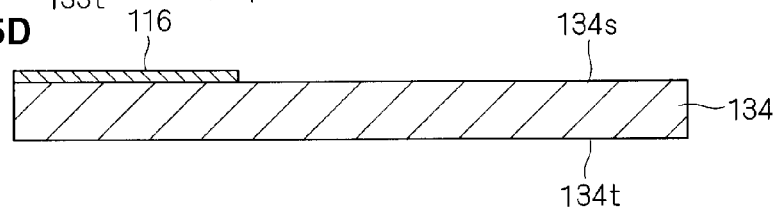
Figure 16:
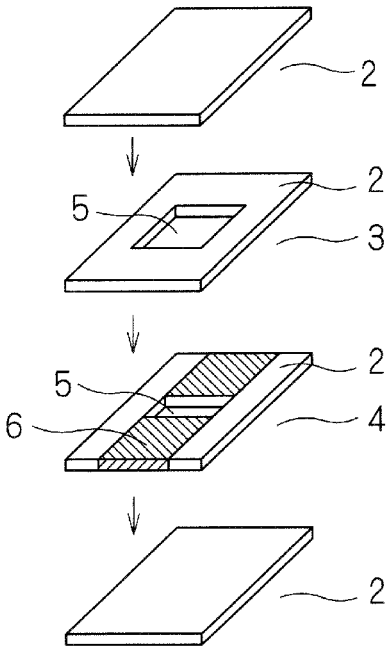
FIG. 16 PRIOR ART
FIG. 16 is an exploded perspective view of an ESD protection device according to an existing example.
Figure 17:
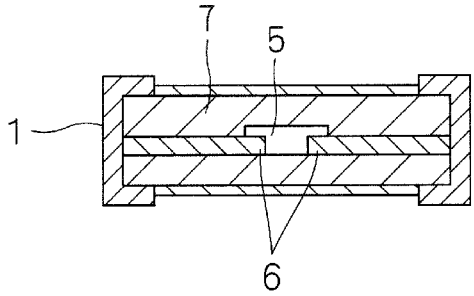
FIG. 17 PRIOR ART
FIG. 17 is a sectional view of an ESD protection device according to an existing example.

Subsequently, as illustrated in FIG. 15B to 15D, the electrode paste is used to form the first to third in-plane connecting conductors 114*a*, 114*b*, and 116 on the ceramic green sheets that are to serve as the second to fourth insulating layers 132 to 134.

Alternatively, the portions that are to serve as the first and second mixture portions 120*a* and 120*b* and the portions that are to serve as the first to third in-plane connecting conductors 114*a*, 114*b*, and 116 may be formed on the opposite side, that is, the ceramic green sheets that are to serve as the first to third insulating layers 131 to 133.

After the portions that are to serve as the first to third in-plane connecting conductors 114*a*, 114*b*, and 116 are formed, the portions that are to serve as the first and second mixture portions 120*a* and 120*b* may be formed.

The paste for forming the sealing layers 122, 124, 126, and 128 is prepared in the same manner as in the electrode paste. For example, a solvent is added to 80 wt % of an $Al_2O_3$ powder having an average particle size of about 1 μm and a binder resin containing ethyl cellulose or the like; the resultant substance is stirred and mixed with a roll to provide the paste (alumina paste) for forming the sealing layers. The solid component of the paste for forming the sealing layers is selected from materials having a higher sintering temperature than the material of the ceramic multilayer substrate, such as alumina, zirconia, magnesia, mullite, and quartz.

As described above, by making at least one of the discharge electrodes be an interlayer connecting conductor, the reliability of the ESD protection function can be enhanced. In addition, desired ESD responsivity can be easily achieved.

The present invention is not limited to the above-described preferred embodiments and encompasses various modifications.

For example, the case in which the ESD protection device is a single component (ESD protection device) having an ESD protection function only has been described as an example. Alternatively, the ESD protection device may be, for example, a composite component (module) having the ESD protection function and another function. When the ESD protection device is, for example, such a composite component (module), it at least includes an interlayer connecting conductor, the first and second mixture portions connected to the interlayer connecting conductor, and another connecting conductor (in-plane connecting conductor or another interlayer connecting conductor) connected to the first and second mixture portions.

The mixture portions and connecting conductors may be formed on the surface of the ceramic multilayer substrate. In this case, the mixture portions and connecting conductors that are exposed on the surface of the ceramic multilayer substrate are preferably covered with a cover layer having an insulating property or covered with cover members that are separated from each other.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ESD protection device comprising:

a ceramic multilayer substrate including a plurality of ceramic insulating layers laminated on each other;

a first connecting conductor that has electrical conductivity and completely fills a via hole which penetrates through at least one of the plurality of ceramic insulating layers;

a mixture portion that extends along one of the main surfaces of the at least one of the plurality of ceramic insulating layers including the first connecting conductor and is connected to the first connecting conductor, the mixture portion including a material dispersed therein, the material including at least one selected from (i) a metal and a semiconductor, (ii) a metal and a ceramic, (iii) a metal, a semiconductor, and a ceramic, (iv) a semiconductor and a ceramic, (v) a semiconductor, (vi) a metal coated with an inorganic material, (vii) a metal coated with an inorganic material and a semiconductor, (viii) a metal coated with an inorganic material and a ceramic, and (ix) a metal coated with an inorganic material, a semiconductor, and a ceramic; and a second connecting conductor that has electrical conductivity, is separated from the first connecting conductor, is connected to the mixture portion, and extends along the main surface of the at least one of the plurality of ceramic insulating layers on which the mixture portion is provided.

2. The ESD protection device according to claim 1, wherein the second connecting conductor extends along the main surface of the at least one of the plurality of ceramic insulating layers on which the mixture portion is provided, surrounds an outer periphery of the mixture portion, and is electrically connected to the outer periphery of the mixture portion; and the first connecting conductor is concentric with the mixture portion, extends through the main surfaces of the at least one of the plurality of ceramic insulating layers, and is electrically connected to the mixture portion so as to be separated from the outer periphery of the mixture portion.

3. The ESD protection device according to claim 1, wherein a hollow portion is in contact with the mixture portion and a main surface of the second connecting conductor.

4. The ESD protection device according to claim 1, wherein the first connecting conductor is directly connected to the mixture portion.

5. The ESD protection device according to claim 1, wherein an opening is defined in a center of the mixture portion;

the ESD protection device further comprises a third connecting conductor that has electrical conductivity, extends along the main surface of the at least one of the plurality of ceramic insulating layers on which the mixture portion is formed, and is connected to an periphery of the opening of the mixture portion; and the first connecting conductor is connected to the third connecting conductor.

6. The ESD protection device according to claim 1, wherein, in the mixture portion, a metal material and a semiconductor material are dispersed.

7. The ESD protection device according to claim 6, wherein the semiconductor material is silicon carbide or zinc oxide.

8. The ESD protection device according to claim 1, wherein, in the mixture portion, a metal material coated with an insulating inorganic material is dispersed.

9. The ESD protection device according to claim 1, further comprising a sealing layer disposed between the at least one of the plurality of ceramic insulating layers and the mixture portion and/or between the at least one of the plurality of ceramic insulating layers and the hollow portion, so as to extend along at least one of the plurality of ceramic the insulating layers.

10. The ESD protection device according to claim 1, wherein a hollow is in contact with the first connecting conductor, the mixture portion, and the second connecting conductor.

11. The ESD protection device according to claim 10, wherein, in the mixture portion, a metal material and a semiconductor material are dispersed.

12. The ESD protection device according to claim 11, wherein the semiconductor material dispersed in the mixture portion is silicon carbide or zinc oxide.

13. The ESD protection device according to claim 1, wherein, in the mixture portion, metal material particles coated with an insulating inorganic material are dispersed.

14. The ESD protection device according to claim 1, further comprising a sealing layer disposed between the insulating layer and the mixture portion and/or between the at least one of the plurality of ceramic insulating layers and the hollow, so as to extend along the at least one of the plurality of ceramic insulating layers.

* * * * *